US006880908B2

(12) United States Patent
Ootsubo et al.

(10) Patent No.: US 6,880,908 B2
(45) Date of Patent: Apr. 19, 2005

(54) INKJET RECORDING APPARATUS

(75) Inventors: Kensei Ootsubo, Fukuoka (JP); Masaharu Tanaka, Fukuoka (JP); Tadashi Maki, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/412,583

(22) Filed: Apr. 14, 2003

(65) Prior Publication Data

US 2003/0206222 A1 Nov. 6, 2003

Related U.S. Application Data

(62) Division of application No. 09/885,101, filed on Jun. 21, 2001, now Pat. No. 6,572,211.

(30) Foreign Application Priority Data

Jun. 22, 2000 (JP) ..... 2000-187278
Jun. 22, 2000 (JP) ..... 2000-187279
Jun. 22, 2000 (JP) ..... 2000-187280

(51) Int. Cl.[7] ..... B41J 29/38; B41J 11/046
(52) U.S. Cl. ..... 347/16; 400/582
(58) Field of Search ..... 347/5, 108, 14, 347/16, 19, 37, 104; 400/582, 583

(56) References Cited

U.S. PATENT DOCUMENTS 5,276,466 A 1/1994 Tsukada et al.
5,596,358 A 1/1997 Hunt et al.
5,816,721 A 10/1998 Palmer et al.
5,914,736 A 6/1999 Tamura
6,017,114 A * 1/2000 Elgee et al. ..... 347/40
6,116,795 A 9/2000 Ogasawara
6,364,549 B1 4/2002 Lesniak et al.
6,428,224 B1 * 8/2002 Askren et al. ..... 400/582

* cited by examiner

*Primary Examiner*—Thinh Nguyen
*Assistant Examiner*—Julian D. Huffman
(74) *Attorney, Agent, or Firm*—Wenderoth, Lind & Ponack, L.L.P.

(57) ABSTRACT

An inkjet recording apparatus includes (a) a carriage, (b) a recording head mounted to the carriage, (c) a transferring machine for transferring a recording medium, (d) a driving machine for operating the transferring machine, (e) a driving-force-transmitting-machine disposed between the transferring machine and the driving machine, and for transmitting the driving force of the driving machine, (f) a rotary detector mounted to a rotating shaft of any one of rotating members constituting the driving-force-transmitting-machine, and disposed within the height of the driving-force-transmitting-machine, and (g) a detecting sensor for detecting a rotating angle of the rotary detector. In this structure, even if other members hit an element of the driving-force-transmitting-machine, they never hit the rotary detector. Thus the rotary detector is prevented from being damaged or deformed due to shocks.

51 Claims, 10 Drawing Sheets

INKJET RECORDING APPARATUS

This application is a divisional application of application Ser. No. 09/885,101, filed Jun. 21, 2001 now U.S. Pat. No. 6,572,211.

FIELD OF THE INVENTION

The present invention relates to an inkjet recording apparatus, which ejects ink from nozzles and attaches the ink to a recording medium, thereby recording information.

BACKGROUND OF THE INVENTION

Inkjet recording apparatus are capable of printing high-quality letters at a high speed and at a low cost. The apparatus are employed in copy machines, facsimile machines, printers and word-processors, and are thus widely used as information recording apparatus in offices as well as for personal use. Various techniques have been proposed to improve the inkjet recording apparatus, and nowadays these techniques still focus on higher speed recording, higher resolution, and full-color printing.

The following recording methods are available in inkjet recording: a method employing an electro-thermal transducing element, such as a heating resistor, as an energy-generating-means for expelling color material; a method employing an electromechanical transducing element such as a piezo element; an electrostatic method employing electrical energy as it is; and the like. Regarding a recording head employed in the apparatus, a serial scanning head has been commercialized. This head is mounted to a carriage and movable in a direction (main scanning direction) orthogonal to a transfer direction of recording paper (sub-scanning direction).

As a means for high speed recording, a dc motor is employed in the apparatus as a transfer motor for driving a transfer roller which transfers recording paper. This dc motor provides for easy speed adjustment and relatively large torque. A rotary detector is provided for detecting a rotating angle of the transfer motor in order to correctly control the feeding amount of the recording paper. On the rotary detector, radially extending slits are formed along the entire rim of the rotary detector at equal intervals.

The rotary detector is disposed coaxially with any gear (rotating member) of a transmission gear-train (driving force transmitting machine) which is placed between the transfer motor and the transfer roller. The transmission gear-train transmits the driving force of the transfer motor to the transfer roller.

The structure of the conventional inkjet recording apparatus discussed above has the following problems. The first problem relates to damage of the rotary detector. The rotary detector is often formed of thin plastic members. Such a delicate detector is vulnerable to being damaged due to a careless mistake by an operator at an apparatus assembly line, e.g., a shock by collision with another member. If the rotary detector is damaged, it is impossible to detect a rotating angle with a detecting sensor, or if the rotary detector is deformed, the rotating face of the detector shakes, and it is impossible to detect a correct rotating angle.

The second problem refers to stains on the rotary detector. The rotary detector can detect a rotating angle at greater accuracy with a larger diameter. However, the larger diameter for the greater accuracy prevents the apparatus from being downsized. When a high-quality letter is printed at a high speed, the recording head moves rapidly and the nozzle ejects smaller amount of ink, and thus the ink tends to scatter. Then the scattered ink attaches to the rotary detector, thereby producing an error in detecting a rotating angle. A smaller diameter of the rotary detector would avoid this problem; however, the smaller detector would produce another problem, i.e., lowering the accuracy of detecting a rotating angle.

The third problem relates to eccentricity of the rotary detector. The rotary detector must be mounted to a rotating shaft without eccentricity both in radial and thrust directions. Therefore, it is preferable to be to able check the eccentricity of the detector with ease.

The fourth problem relates to the size of the rotary detector. For detecting a rotating angle of the transfer motor, it is required to optically detect, with a detecting sensor, a number of slits of the rotary detector as the rotary detector is rotated by the transfer motor. When the detecting sensor is a transmission type sensor, its light-emitting-section and light-receiving-section are placed at both sides of the rotary detector, and the detecting sensor is mounted to the rim of the rotary detector. As a result, the detecting sensor protrudes largely in the radial direction compared with the gear disposed coaxially with the rotary detector. This structure is not preferable because it goes against the goal of downsizing the apparatus.

SUMMARY OF THE INVENTION

An objective of the present invention is to overcome the first problem discussed above, and to provide an inkjet recording apparatus which can avoid damage or deformation during assembly of the rotary detector to be mounted to a driving-force-transmitting-machine. The inkjet recording apparatus of the present invention comprises the following elements:

(a) a carriage disposed to be movable reciprocally in parallel with a main scanning direction;

(b) a recording head mounted to the carriage, for ejecting ink from a plurality of nozzles;

(c) a transferring machine for transferring a recording medium, to which the ink ejected from the recording head attaches thereby forming an image, in a sub-scanning direction orthogonal to the main scanning direction;

(d) a driving machine for operating the transferring machine;

(e) a driving force transmitting machine disposed between the driving machine and the transferring machine, for transmitting driving force of the driving machine to the transferring machine;

(f) a rotary detector disposed within a height of the driving force transmitting machine, and mounted coaxially with the rotary shaft of any one of rotary members constituting the driving force transmitting machine; and (g) a detecting sensor for detecting a rotating angle of the rotary detector.

This structure allows the rotary detector to avoid colliding with other members during assembly of the apparatus even if the other members collide with elements of the driving force transmitting machine. Thus the rotary detector is prevented from being damaged or deformed by a collision.

The present invention overcomes the second and third problems discussed previously, and aims to provide an inkjet recording apparatus which can detect the rotating angle of the rotary detector with high accuracy, and yet, downsize the rotary detector. Besides, the apparatus can check eccentricity of the rotary detector mounted to the rotating shaft with ease.

The inkjet recording apparatus of the present invention comprises the following elements:

(a) a carriage disposed to be movable reciprocally in parallel with a main scanning direction;

(b) a recording head mounted to the carriage, for ejecting ink from a plurality of nozzles;

(c) a transferring machine for transferring a recording medium, to which the ink ejected from the recording head attaches thereby forming an image, in a sub-scanning direction orthogonal to the main scanning direction;

(d) a driving machine for operating the transferring machine;

(e) a driving force transmitting machine disposed between the driving machine and the transferring machine, for transmitting driving force of the driving machine to the transferring machine;

(f) a rotary detector mounted coaxially with a rotary shaft of any one of gears constituting the driving force transmitting machine, and slits—extending in the radial direction of the detector—being provided on the entire rim of the detector at equal intervals, and at least a part of the slits being disposed within a height of a tooth form of the gears; and (g) a detecting sensor for detecting a rotating angle of the rotary detector by detecting a number of slits of the rotary member during rotation of the rotary detector.

Since at least a part of the slits of the rotary detector are placed within the height of tooth form of the gears, this structure allows the rotary detector to be accurately detected and downsized. Further, rotating conditions of the rotary detector can be compared with that of the gears by rotating the shaft, so that the eccentricity of the rotary detector can be checked with ease.

The present invention overcomes the fourth problem discussed previously, and aims to provide an inkjet recording apparatus having a transmission type detecting sensor disposed with respect to the rotary detector mounted coaxially with a rotary member. In this transmission type detecting sensor, a radially outward protrusion amount of the sensor with respect to the rotary member can be limited. The inkjet recording apparatus of the present invention comprises the following elements:

(a) a carriage disposed to be movable reciprocally in parallel with a main scanning direction;

(b) a recording head mounted to the carriage, for ejecting ink from a plurality of nozzles;

(c) a transferring machine for transferring a recording medium, to which the ink ejected from the recording head attaches thereby forming an image, in a sub-scanning direction orthogonal to the main scanning direction;

(d) a driving machine for operating the transferring machine;

(e) a driving force transmitting machine disposed between the driving machine and the transferring machine, for transmitting driving force of the driving machine to the transferring machine;

(f) a rotary detector mounted coaxially with a rotary shaft of any one of the rotary members constituting the driving force transmitting machine, and slits—extending in the radial direction of the detector—being provided on the entire rim of the detector at equal intervals; and (g) a detecting sensor including:

(g-1) a light-emitting-section for irradiating a beam of detecting light to the slits on the rotating detector; and (g-2) a light-receiving-section for receiving the beam of detecting light irradiated from the light-emitting-section, and disposed opposite to the light-emitting-section with respect to the rotary detector.

This sensor recognizes light-shading and light-transmission of the detecting light at the light-receiving-section, thereby detecting the rotating angle of the rotary detector. The light-shading and light-transmission of the detecting light is produced when the rotary detector rotates and the slits move. Either one of the light-emitting-section or the light-receiving-section is disposed between the rotating member and the rotary detector. This structure allows the rotary detector to have approximately the same diameter as the rotary member. Thus the detecting sensor disposed with respect to the rotary detector can limit the radially outward protrusion amount of the rotary member.

DETAILED DESCRIPTION OF THE INVENTION

Exemplary embodiments of the present invention are demonstrated hereinafter with reference to the accompanying drawings.

First Exemplary Embodiment

Figure 1:
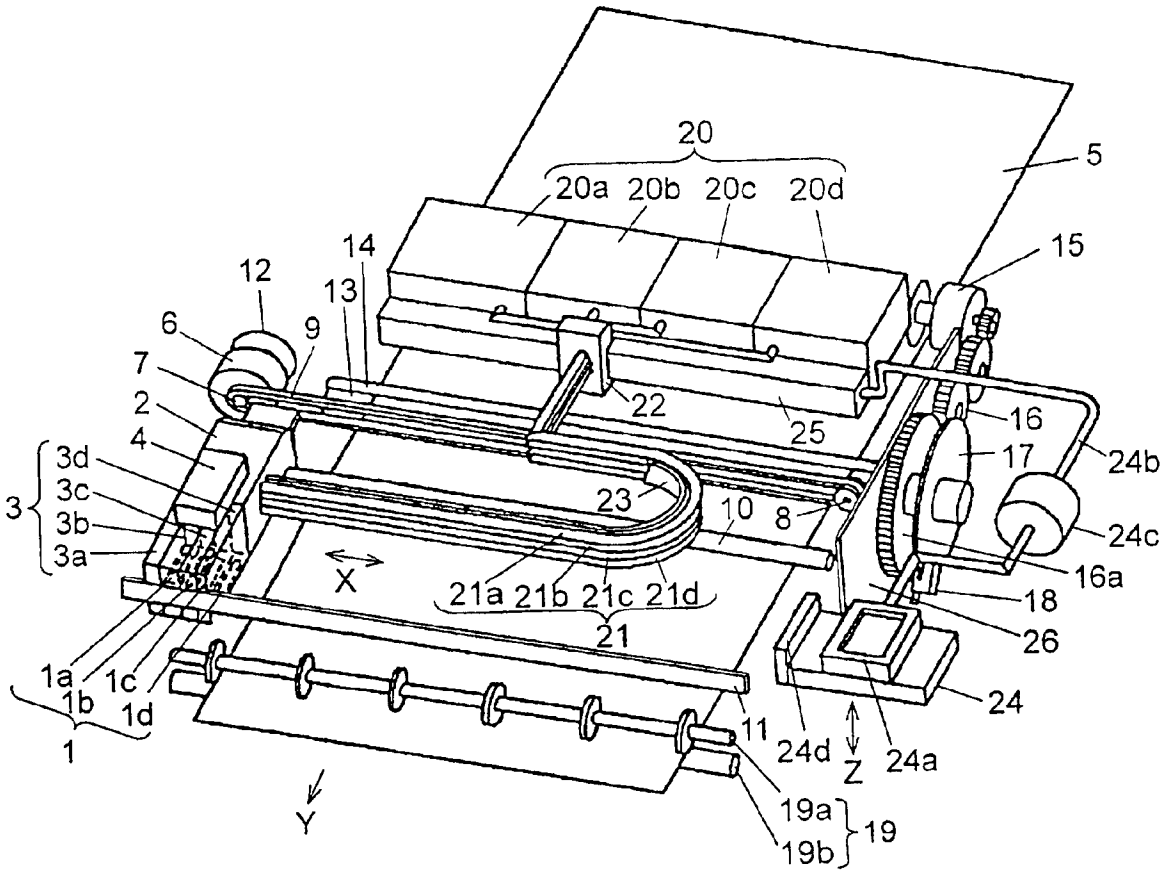
FIG. 1 is a schematic perspective view of an inkjet recording apparatus in accordance with a first exemplary embodiment of the present invention.
Figure 2:
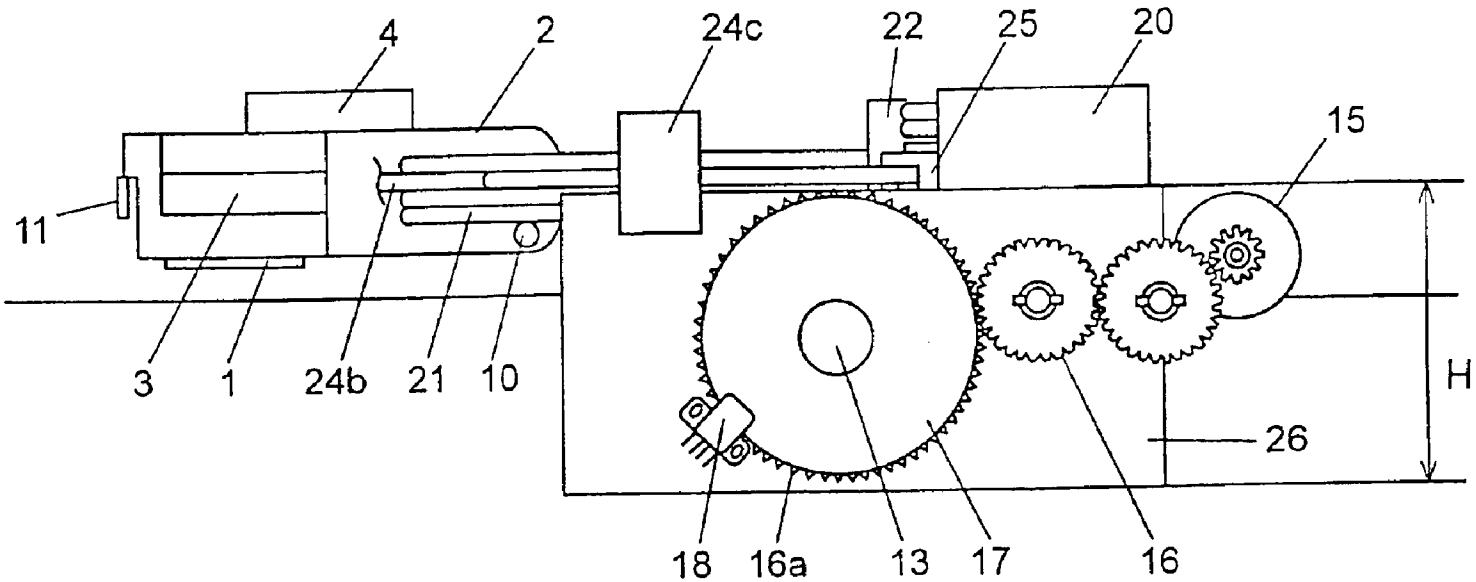
FIG. 2 is a lateral view illustrating an essential part of the inkjet recording apparatus shown in FIG. 1.
Figure 3:
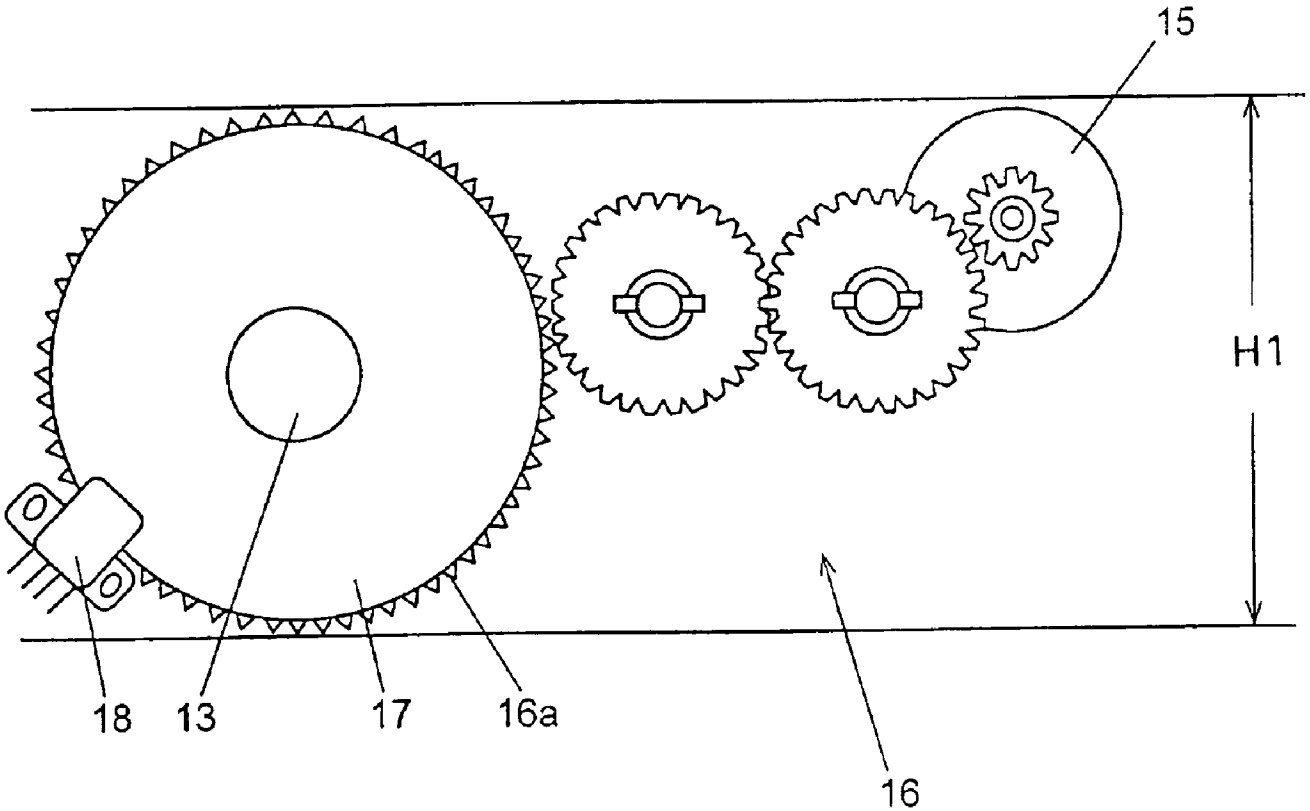
FIG. 3 illustrates an example of a height of a transmission-gear-train shown in FIG. 2.
Figure 4:
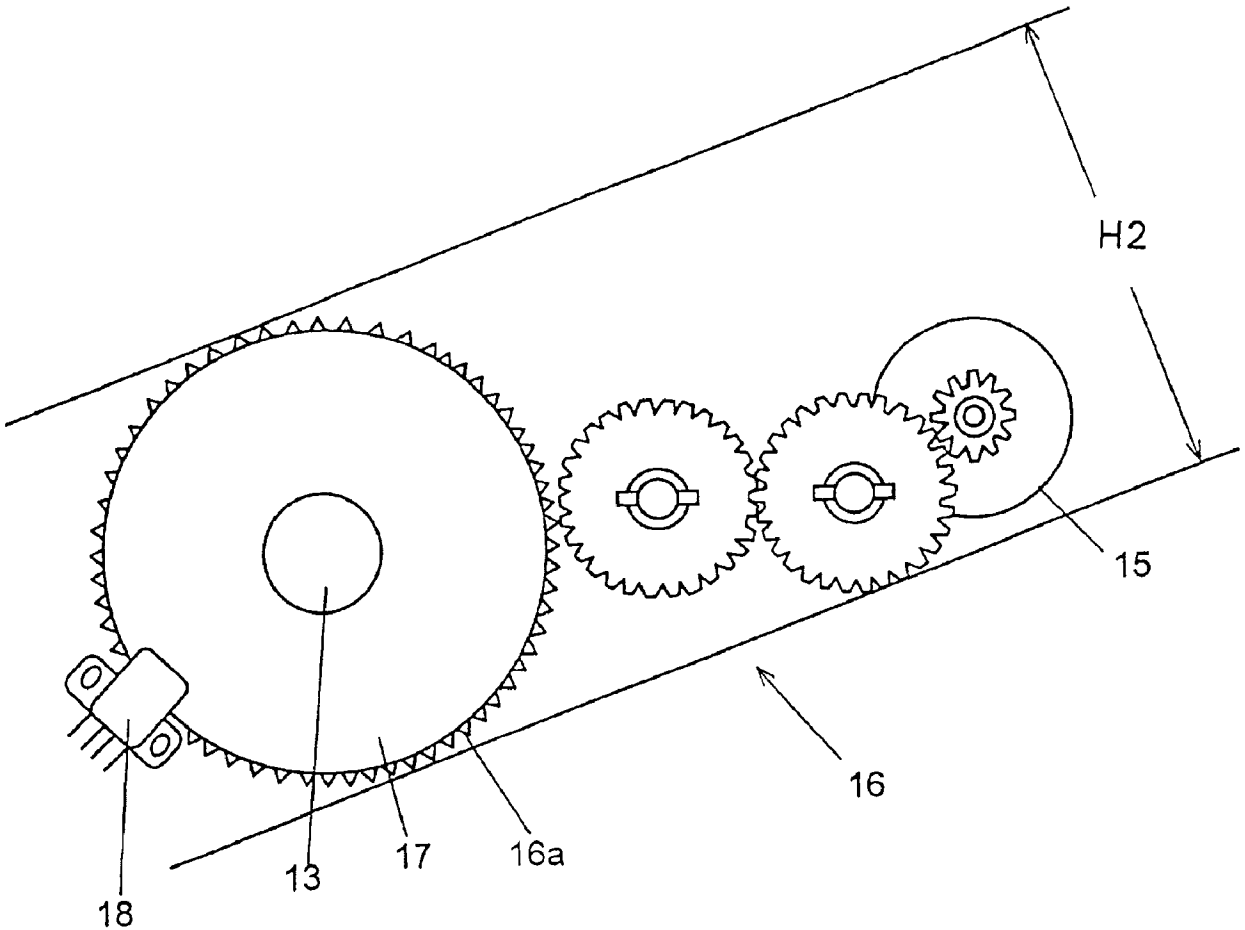
FIG. 4 illustrates another example of the height of the transmission-gear-row.
Figure 5:
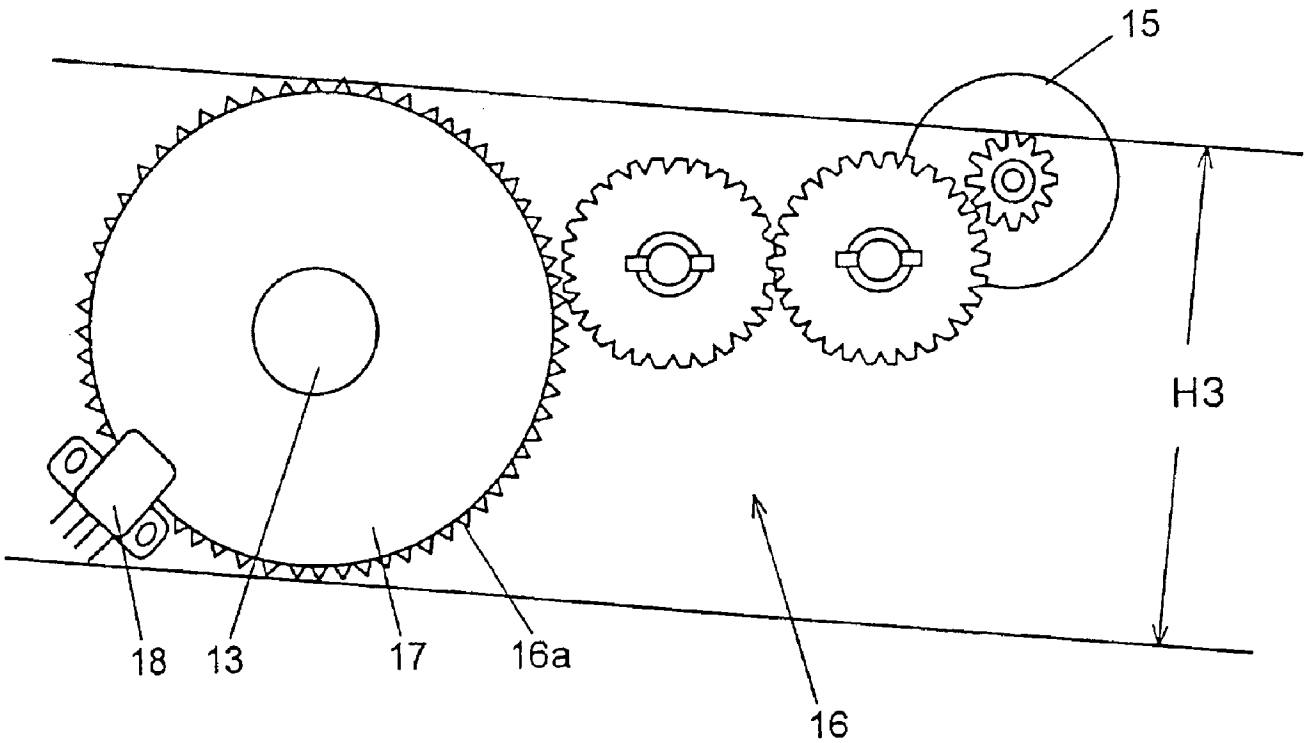
FIG. 5 illustrates still another example of the height of the transmission-gear-train.

FIG. 1 is a schematic perspective view of an inkjet recording apparatus in accordance with the first exemplary embodiment of the present invention. FIG. 2 is a lateral view illustrating an essential part of the inkjet recording apparatus shown in FIG. 1. FIG. 3 illustrates an example of a height of a transmission-gear-train shown in FIG. 2. FIG. 4 illustrates another example of the height of the transmission-gear-train. FIG. 5 illustrates still another example of the height of the transmission-gear-train. In these drawings, the same elements bear the same reference marks, and duplicate descriptions are avoided.

In FIG. 1, the inkjet recording apparatus, in accordance with the first embodiment, includes a recording head 1 which ejects a plurality of colored inks. Head 1 comprises black-recording-head 1*a* for ejecting black ink, yellow-recording-head 1*b* for ejecting yellow ink, magenta-recording-head 1*c* for ejecting magenta ink, and cyan-recording-head 1*d* for ejecting cyan ink. A plurality of nozzles (not shown) are formed in respective heads 1*a*, 1*b*, 1*c* and 1*d*. Sub-tanks 3 (i.e., 3*a*, 3*b*, 3*c* and 3*d*) disposed above the respective heads 1*a*, 1*b*, 1*c* and 1*d*. The sub-tanks 3*a*, 3*b*, 3*c* and 3*d* hold black ink, yellow ink, magenta ink and cyan ink, respectively, and supply the ink to the corresponding heads 1*a*, 1*b*, 1*c* and 1*d*. Head 1 and sub-tanks 3 are disposed in parallel with a carriage 2 in the moving direction of carriage 2.

Heads 1*a*, 1*b*, 1*c* and 1*d* can be independent or united (linked). The number of colors is not limited to four as described in this embodiment. If the number of colors is other than four, the numbers of recording heads, ink-tanks, sub-tanks and supplying tubes are varied accordingly.

A pressure chamber to be filled with ink and a piezoelectric actuator (both are not shown) are disposed at a location corresponding to the nozzles of a head. The actuator includes a piezoelectric element and deforms the pressure chamber by applying a pulse voltage to the piezoelectric element so that the pressure chamber reduces its own capacity.

A driving circuit 4, disposed at carriage 2, operates the piezoelectric actuator, so that the ink in the pressure chamber is ejected downwardly from the nozzles to a recording paper 5 (recording medium), which is transferred in a Y direction (transfer direction) shown in FIG. 1. Instead of the piezoelectric actuator, a thermal actuator or an electrostatic actuator conventionally known can be used.

Recording head 1 is rigidly mounted to carriage 2, which is movable in an X direction (main scanning direction) relative to recording paper 5. The X direction is orthogonal to the Y direction, i.e., the main scanning direction crosses the sub-scanning direction, namely, the transfer direction, at right angles.

Carriage 2 reciprocates above recording paper 5 and has the following structure. A carriage driving motor 6 is disposed at a first side of the apparatus in the X direction. An endless carriage driving belt 9 is looped on a driving pulley 7 and a follower pulley 8. Driving pulley 7 is mounted to the shaft of motor 6, and follower pulley 8 is disposed at a side of the apparatus opposite the pulley 7, i.e., at a second side of the X direction. Carriage 2 is rigidly placed in the span under belt 9. Motor 6 spins apparatus in normal and reverse directions, so that belt 9 loops also in a normal or a reverse direction. A carriage shaft 10 extends in the X direction and is mounted to the apparatus. Shaft 10 extends through carriage 2, which can slide with respect to shaft 10. Further, guide rail 11 is disposed on the other side of carriage 2 with respect to shaft 10, and runs parallel to shaft 10. Carriage 2 is guided by guide rail 11 such that carriage 2 can slide with respect to guide rail 11.

The structure discussed above allows belt 9 to loop around pulleys 7, 8 by spinning motor 6 in a normal or a reverse direction. Then carriage 2 fixed to belt 9 shuttles back and forth in the X direction (scanning direction) above recording paper 5 while being supported by shaft 10 and guide rail 11.

Motor 6 is equipped with a rotary detector 12, which detects the rotating amount of motor 6, i.e., a position of head 1 in the X direction, with a detecting sensor (not shown).

A transferring machine, i.e., a transfer roller 13 is disposed under recording paper 5 extending in the X direction. A pinch roller 14 is disposed above recording paper 5 extending in the X direction. Pinch roller 14 urges recording paper 5 against transfer roller 13. In other words, recording paper 5 is pinched between transfer roller 13 and pinch roller 14.

A driving machine, i.e., a transfer motor 15 is disposed at the second side of the apparatus in the X direction and behind pinch roller 14 in the Y direction. Transfer motor 15 is a dc motor. Between motor 15 (driving machine) and transfer roller 13 (transfer machine), a driving-force-transmitting machine for transmitting the driving force of motor 15 to roller 13, i.e., a transfer-gear-train 16, is mounted to a chassis 26. This structure allows roller 13 to be driven by motor 15 via gear-train 16 and transfer recording paper 5 in the Y direction. At this time, pinch roller 14 is a follower driven via recording paper 5 as recording paper 5 is transferred.

In this first embodiment, the driving force transmitting machine comprises transmission-gear-train 16 formed of plural gears. The driving force of transfer motor 15 is transmitted by this transmission-gear-train 16; however, it is not limited to gear-train 16. For instance, in the driving force transmitting machine, various means such as a pulley and a belt, a gear and a shaft, or combining these tools, can transmit the driving force of motor 15 to roller 13.

A final gear 16*a*, which is an element of the transmission-gear-train 16, is mounted coaxially with the rotating shaft of roller 13 on one end of roller 13. Further, a rotary detector 17 is also mounted coaxially with the rotating shaft of roller 13 at an outer side of final gear 16*a*.

About the entire rim of rotary detector 17, a plurality of radially extending slits are formed at equal intervals. A detecting sensor 18 is disposed at a predetermined place with respect to rotary detector 17 for detecting positions of each slit to be detected (detection portion). Detecting sensor 18 comprises a light-emitting-section and a light-receiving-section. The light-emitting-section irradiates detecting-light to rotary detector 17. The light-receiving-section is disposed opposite the light-emitting-section with respect to rotary detector 17, and receives the detecting-light irradiated from the light-emitting-section. When rotary detector 17 rotates accompanying the rotation of gear 16*a*, numbers of light-shadings and light-transmissions of the detecting light due to movement of the slits are recognized by the light-receiving-section. Thus a rotating angle of rotary detector 17 is detected, and the rotating volume of transfer motor 15, i.e., feeding-amount of recording paper 5 can be detected.

Detecting sensor 18 is not limited to the transmission type detector discussed above, and a reflecting type detector can be employed, for which both the light-emitting-section and the light-receiving-section are disposed at the same side of the rotary detector. Thus the light from the light-emitting-section reflects on the rotary detector and the reflected light can be detected by the light-receiving-section.

A pair of discharging rollers 19 (19*a*, 19*b*) for pinching and discharging recording paper 5 outside the apparatus are disposed in front of transfer roller 13 in the transfer direction (Y direction) of recording paper 5. Discharging rollers 19 synchronously rotate with roller 13.

As shown in FIG. 1, a main tank 20 is disposed between pinch roller 14 and transfer motor 15. Main tank 20 comprises four tanks 20*a*, 20*b*, 20*c* and 20*d*, in which black ink, yellow ink, magenta ink and cyan ink are held, respectively. These four tanks are aligned in X direction and rigidly mounted to the apparatus.

Respective main tanks 20*a*, 20*b*, 20*c* and 20*d* are coupled to corresponding sub-tanks 3*a*, 3*b*, 3*c* and 3*d* through four flexible tubes 21*a*, 21*b*, 21*c* and 21*d* (collectively, 21) so that the ink in the main tanks can be supplied to the sub-tanks. A coupling member 22 is disposed in front of main tank 20 in the Y direction. The four tubes 21 are bound together and aligned vertically by coupling member 22. The four tubes 21 extend in the Y direction, then turn along the X direction toward pulley 8, and are bowed before extending oppositely in the X direction, and finally arrive at carriage 2. When carriage 2 moves in the X direction, the bowed section of tube 21 moves accordingly, so that carriage 2 can travel smoothly.

Sub-tanks 3 reserve the enough ink to print several sheets of recording paper 5 of A4 size. The inks in sub-tanks 3 are ejected during the printing. Then sub-tanks 3 are supplied with the inks from main tanks 20 while the next recording paper 5 is fed in.

As such, sub-tanks 3 are provided to carriage 2, thereby speeding up ink-supply and preventing ink-shortage. The sub-tanks 3 are so small that the carriage 2 is overall light in weight, thereby speeding up the traveling speed of carriage 2 as well as downsizing the apparatus due to narrowing of the required traveling space of carriage 2.

Besides one end of the tubes 21, one end of a flexible cable 23 is connected to a side face of carriage 2. Cable 23 transmits a printing signal, for ejecting the ink from heads 1, from a printing signal generator (not shown) to driving circuit 4. The printing signal transmitted via cable 23 drives the piezoelectric element, so that the inks are ejected from the nozzles of heads 1.

At the position opposite to the home position of carriage 2 on the first side of the apparatus in the X direction, a purge-unit 24 is disposed on the second side of the apparatus in the X direction. This purge-unit 24 is a suction machine attached to the nozzles of head 1 for sucking ink and thereby cleaning the nozzles. Purge-unit 24 comprises a cap 24*a*, an ink-discharging-tube 24*b* and a suction pump 24*c*. Cap 24*a* moves in a Z direction (perpendicular to the X and Y directions) and sticks to head 1 so that openings of all the nozzles of head 1 can be covered. The shielded space-formed by sticking cap 24*a* to head 1-communicates with wasted-ink-container 25, disposed adjacent to main tank 20, through tube 24*b*. Suction pump 24*c* is disposed at the middle of tube 24*b*, sucks ink from the nozzles, and then discharges it into container 25.

A wiper 24*d*, which is made of rubber, is disposed near cap 24*a* and is movable in the Z direction independently of cap 24*a* and wipes the nozzles' faces. Wiper 24*d* sticks to the nozzles' faces and retreats therefrom. When wiper 24*d* is urged against the nozzles' faces, carriage 2 is moved in the scanning direction (X direction), so that wiper 24*d* moves with respect to the nozzles' faces and the ink attached to the nozzles' faces can be wiped off.

Next, rotary detector 17 is detailed. As shown generally in FIG. 2, rotary detector 17 is disposed within a height "H" of transmission gear-train 16. The height of transmission gear-train 16 refers to any of the following three heights, i.e., H1, H2 and H3:

"H1": As shown in FIG. 3, when the inkjet recording apparatus is placed on a horizontal plane, the distance between the horizontal line running at the lowest end of gear-train 16 and the horizontal line running at the highest end of gear-train 16 is referred to as height "H1".

"H2", "H3": As shown in FIG. 4 and FIG. 5, only gear-train 16 is selected and placed on a flat face. A tangent line common to any two gears coming in contact with the flat face is considered the lowest end line, and a line parallel to this tangent line and running at the highest end of the gear-train is considered the highest end line. The space between these two lines is referred to as "H2" or "H3".

Rotary detector 17 is placed within the height of gear-train 16. As such, during assembly of the apparatus, even if other members hit rigid elements of gear-train 16, they never hit the thin rotary detector 17. Thus rotary detector 17 can be prevented from being damaged or deformed by a shock. As a result, disablement of the rotating angle detection due to damage to the rotary detector 17 can be avoided. Also, incorrect detection of the rotating angle due to shaking of the rotating face caused by deformation of rotary detector 17 can be avoided.

In addition to placing rotary detector 17 within the height of gear-train 16, rotary detector 17 is mounted to the outside of gear-train 16 as shown in the drawings. Therefore, the ink ejected from the nozzles might splash as far as gear-train 16 but not as far as rotary detector 17 and detecting sensor 18 including the light-emitting-section and the light-receiving-section. Thus a detection error of the rotating angle due to ink being attached to rotary detector 17 or detecting sensor 18 can be prevented.

In general, splashing of the ink tends to happen particularly in high speed printing, or printing of letters with a small dot diameter. For instance, the ink-splash reveals itself as a problem in the following condition aiming at high speed and high quality image recording: resolution ≧600 dpi, printing speed ≧80 cm/sec at ≧20 kHz, ink ejecting amount ≦20 pl. Further, when the ink ejecting amount is less than 4 pl, the problem becomes more serious. Therefore, the fact that the present invention solves the problem of attaching ink to rotary detector 17 is a great advantage for realizing high speed printing and high quality image recording.

Second Exemplary Embodiment

Figure 6:
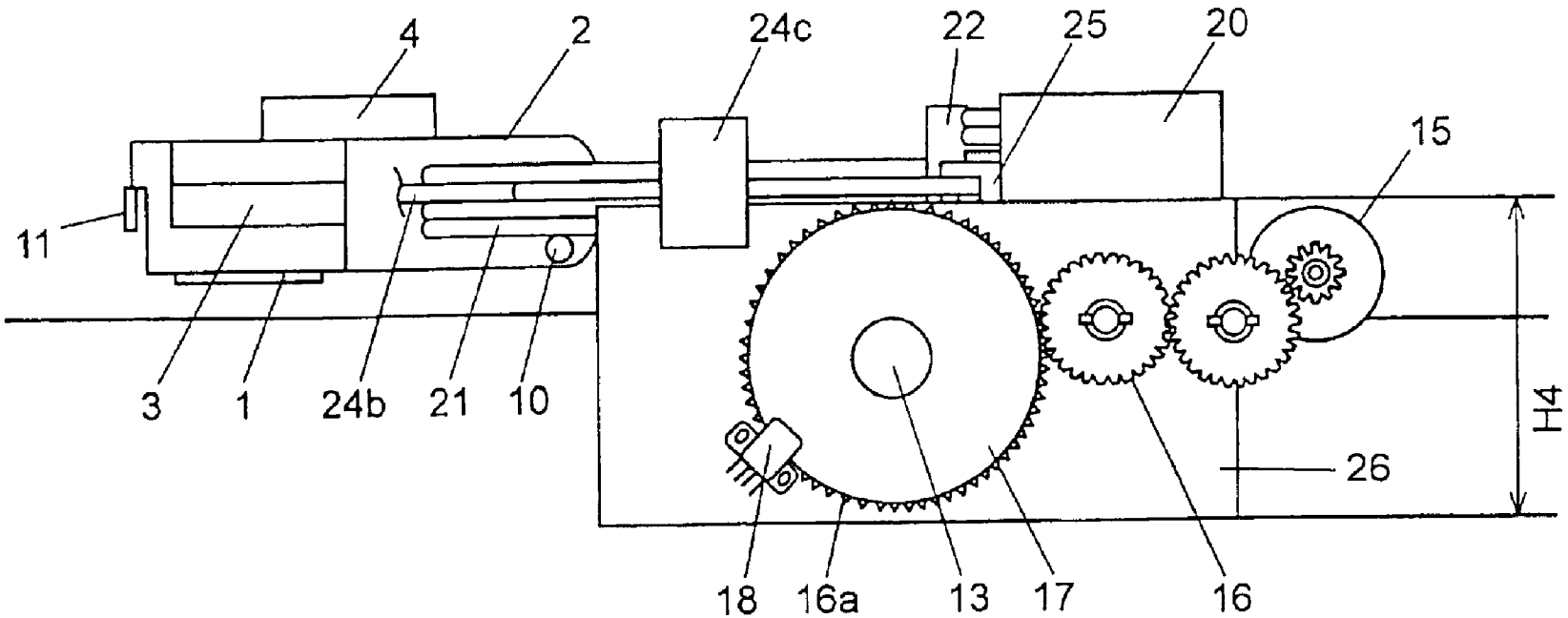
FIG. 6 is a lateral view of an essential part of an inkjet recording apparatus in accordance with a second exemplary embodiment of the present invention.

FIG. 6 is a lateral view of an essential part of an inkjet recording apparatus in accordance with the second exemplary embodiment of the present invention.

In the first embodiment discussed previously, the rotary detector is placed within the height of the transmission gear-train. However, in this second embodiment as shown in FIG. 6, rotary detector 17 is placed within height H4 of chassis 26 to which transmission gear-train 16 is mounted. In this structure, other members might happen to hit transmission gear-train 16 or chassis 26 by mistake; however they hardly hit rotary detector 17. Thus this structure prevents rotary detector 17 from being damaged or deformed by a shock.

Since rotary detector 17 is mounted outside of chassis 26, a rotating angle detection error due to ink becoming attached to detector 17 can be prevented.

In the first and second embodiments, rotary detector 17, together with final gear 16*a*, are mounted to transfer roller 13, so that a rotating angle detection error due to back-lash is eliminated. The rotary detector can be, as long as it is placed within the height of the gear-train or the height of the chassis, mounted coaxially with a rotating shaft of other rotating members such as another gear instead of the final gear.

In the first and second embodiments, main tank 20 is disposed separately from carriage 2; however, the ink tank can be disposed on the carriage side. Further, a cartridge, in which the heads and ink tanks are integrated, can be employed.

In the first and second embodiments, the detecting sensor 18 is described as an optical sensor; however, a magnetic type sensor, comprising magnetic slits and a magnetic detecting sensor, can be used with the same advantages.

Third Exemplary Embodiment

Figure 7:
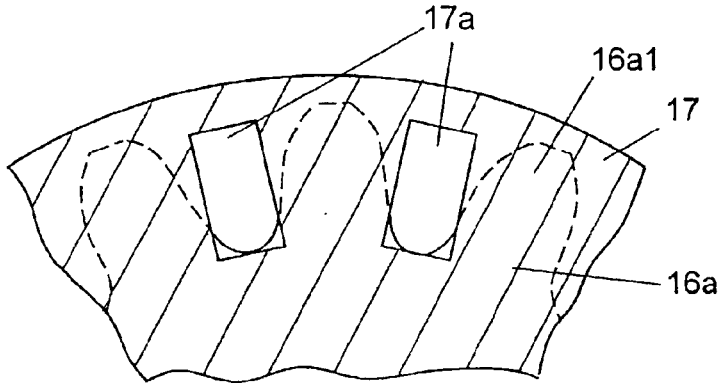
FIG. 7 illustrates an example of a relation between the final gear of a transmission-gear-train and slits formed on a rotary detector in an inkjet recording apparatus in accordance with a third exemplary embodiment.
Figure 8:
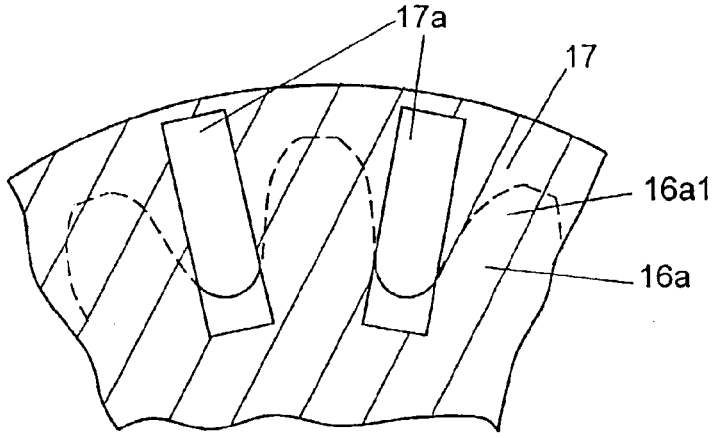
FIG. 8 illustrates another example of the relation between the final gear and the slits.
Figure 9:
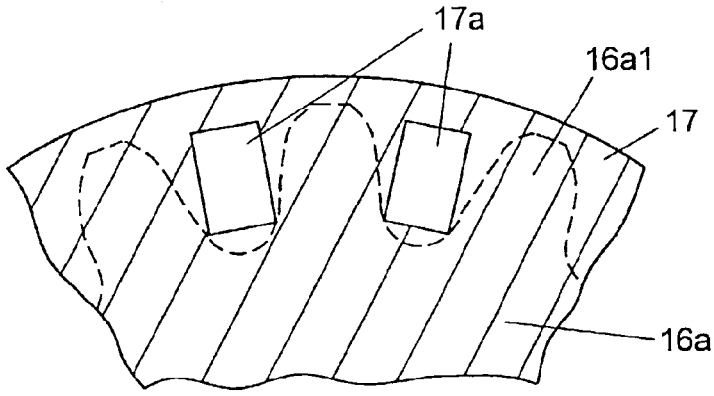
FIG. 9 illustrates still another example of the relation between the final gear and the slits.
Figure 10:
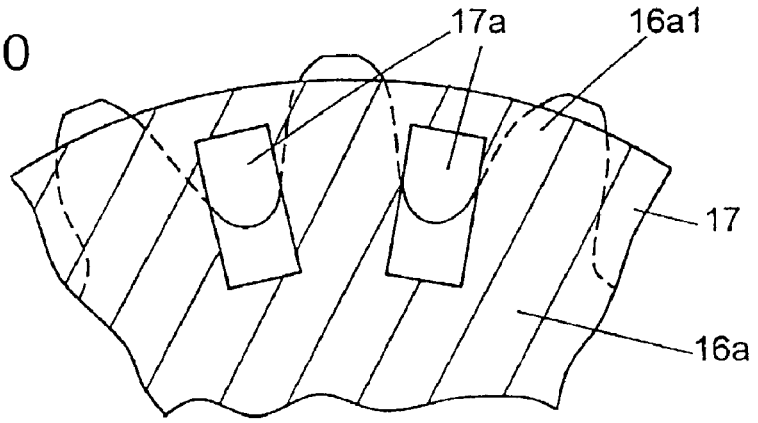
FIG. 10 illustrates yet another example of the relation between the final gear and the slits.
Figure 11:
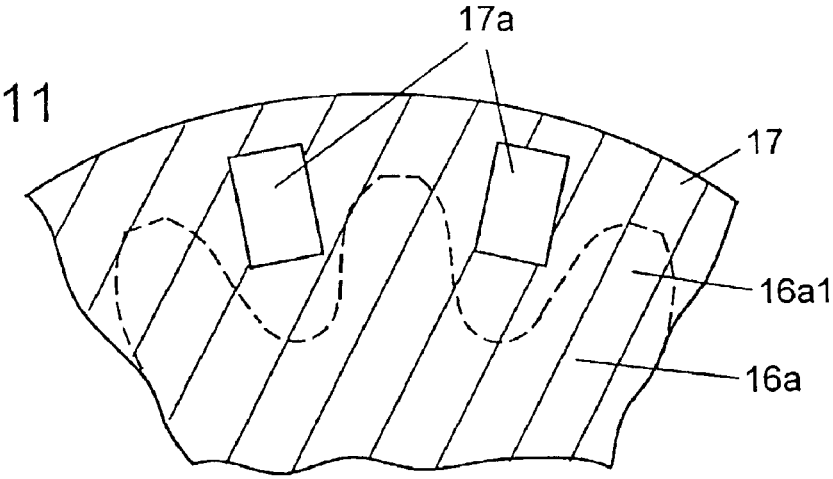
FIG. 11 illustrates yet another example of the relation between the final gear and the slits.
Figure 12:
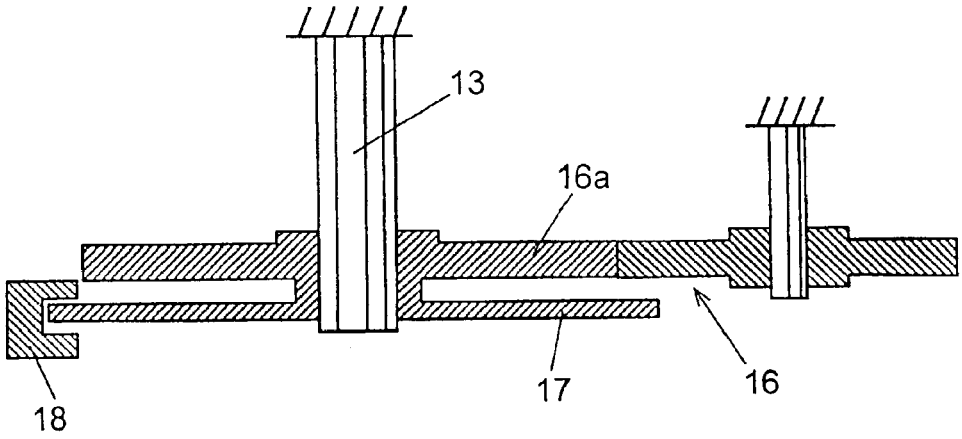
FIG. 12 is a cross sectional view showing the final gear and the rotary detector.

FIG. 7 illustrates an example of a relation between the final gear of a transmission-gear-train and slits formed on a rotary detector in an inkjet recording apparatus in accordance with the third exemplary embodiment. FIG. 8 illustrates another example of the relation between the final gear and the slits. FIG. 9 illustrates still another example of the relation between the final gear and the slits. FIG. 10 illustrates yet another example of the relation between the final gear and the slits. FIG. 11 illustrates a further example of the relation between the final gear and the slits. FIG. 12 is a cross sectional view showing the final gear and the rotary detector. In these drawings, the same elements as those used in the first and second embodiments bear the same reference marks and the descriptions thereof are omitted.

As shown in FIG. 7 through FIG. 11, the third embodiment shows positional relations between slits 17*a* formed on rotary detector 17 and corresponding tooth forms 16*a*1 of final gear 16*a*. In these relations, at least a part of slit 17*a* is placed within the height of tooth form 16*a*1, which is demonstrated in the following examples:

(1) As shown in FIG. 7, the length of slit 17*a* is equal to the height of tooth form 16*a*1.

(2) As shown in FIG. 8, both the ends of slit 17*a* in its longitudinal direction are located outside of both the ends of tooth form 16*a*1 in the height direction.

(3) As shown in FIG. 9, the length of slit 17*a* is within the height of tooth form 16*a*1.

(4) As shown in FIG. 10, the outer end of slit 17*a* in the longitudinal direction is located within the height of tooth form 16*a*1, and the inner end of slit 17*a* in the longitudinal direction is located inside of the inner end of tooth form 16*a*1 in the height direction.

(5) As shown in FIG. 11, the inner end of slit 17*a* in the longitudinal direction is located within the height of tooth form 16*a*1, and the outer end of slit 17*a* is outside the outer end in the height direction of tooth form 16*a*1.

These relations can be applied to a case where a pulley with teeth, or a simple pulley is used instead of gear 16*a*, e.g., in the case of using the pulley, the outside discussed above refers to the outer end of a rib, the inside discussed above refers to a bottom of a tooth in the case of the pulley with teeth, and the inside refers to an inner bottom in the case of a simple pulley.

As such, according to the third embodiment, at least a part of slit 17*a*, formed on rotary detector 17 which is mounted to the rotating shaft of final gear 16*a*, is located within the height of tooth form 16*a*1 of gear 16*a*. Thus while rotary detector 17 can perform detection with high accuracy, it can be downsized.

Rotary detector 17 is disposed outside gear 16*a* with respect to head 1, so that splashed ink-mist does not attach to rotary detector 17, and a rotating angle detection error can be avoided. This advantage becomes effective under the conditions of: resolution ≧600 dpi; printing speed ≧20 kHz, 80 cm/sec; ink ejecting amount ≦20 pl. When the ink ejecting amount is less than 4 pl, this advantage produces a conspicuous effect.

The rotating shaft is spun, so that rotary detector 17 is compared with gear 16*a* in their rotating conditions. Thus the eccentricity of rotary detector 17 can be checked with ease.

As shown in FIG. 12, rotary detector 17 can be unitarily molded with final gear 16*a* which shares the same rotating shaft with detector 17. In this case, co-axiality of rotary detector 17 with gear 16*a* is improved, which allows the detection of the rotating angle to be more accurate.

In the same manner as the first and second embodiments, in this third embodiment, rotary detector 17 is mounted together with final gear 16*a* to transfer roller 13, so that rotating angle detection error due to back-lash can be eliminated. However, rotary detector 17 can be mounted coaxially with a rotating shaft of another gear of the transmission gear-train. Rotary detector 17 is disposed outside gear 16*a*; however, it can be disposed inside thereof.

Fourth Exemplary Embodiment

Figure 13:
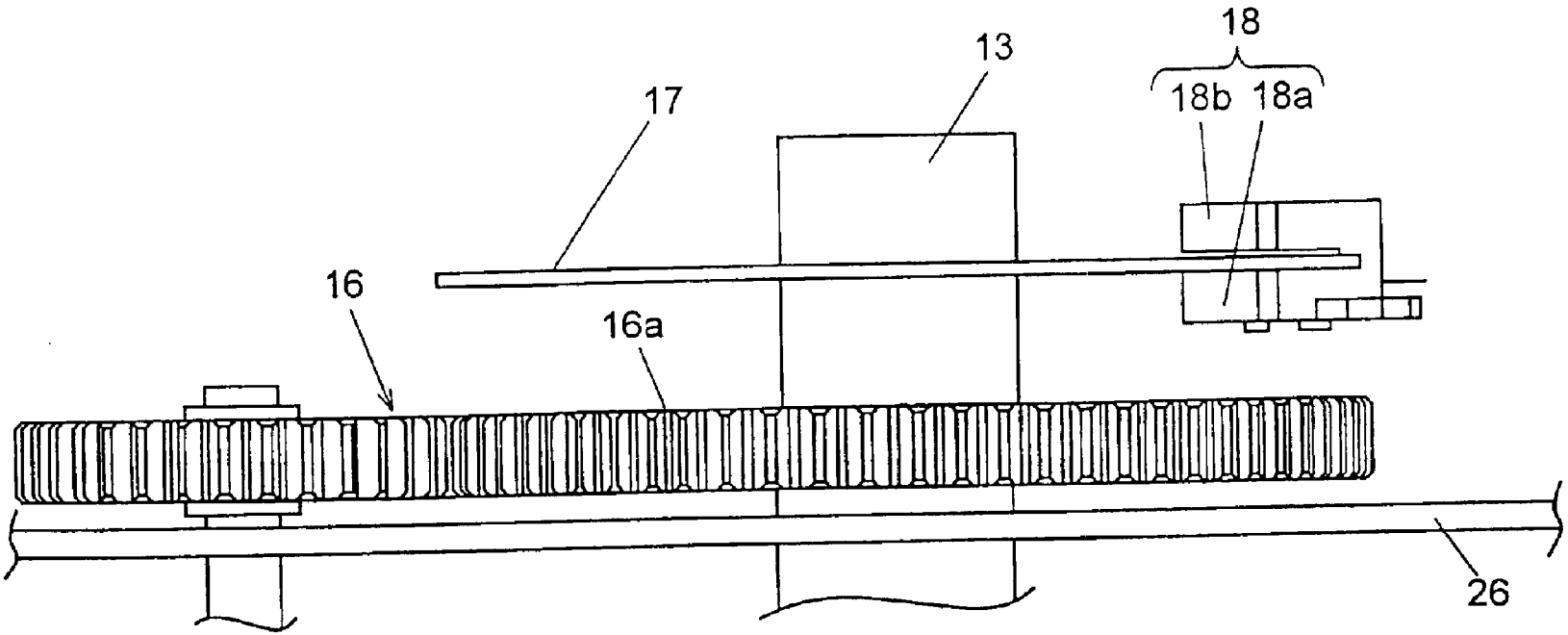
FIG. 13 is a plan view showing an essential part of an inkjet recording apparatus in accordance with a fourth exemplary embodiment.

FIG. 13 is a plan view showing an essential part of an inkjet recording apparatus in accordance with the fourth exemplary embodiment. In FIG. 13, the same elements as those used in the first, second and third embodiments bear the same reference marks, and the descriptions thereof are omitted.

In this fourth embodiment as shown in FIG. 13, light-emitting-section 18*a* of detecting sensor 18 is disposed between final gear 16*a* of the transmission gear-train and rotary detector 17. In this placement, rotary detector 17 has approximately the same diameter as gear 16*a* on the same shaft as detector 17, and therefore, the protrusion amount of sensor 18 in the radial direction of gear 16*a* can be reduced. In particular, if rotary detector 17 has a smaller diameter than gear 16*a*, the protrusion amount of sensor 18 can be further reduced.

Rotary detector 17 is placed outside gear 16*a* with respect to head 1, so that splashed ink-mist cannot attach to rotary detector 17. Thus a rotating angle detection error can be avoided. This advantage becomes effective conspicuously at high speed printing with a small amount of ink ejection as in the first, second and third embodiments.

In this fourth embodiment, light-emitting-section 18*a* of detecting sensor 18 is disposed between gear 16*a* and rotary detector 17; however, light-receiving-section 18*b* can be so disposed instead of light-emitting-section 18*a*. As such, either one of light-emitting-section 18*a* or light-receiving-section 18*b* is disposed between final gear 16*a* and rotary detector 17, so that ink-mist—produced at high speed printing with a small amount of ink ejection—hardly attaches to detecting sensor 18.

In this fourth embodiment, detecting sensor 18 is disposed within height "H" of transmission gear-train 16 as shown in FIG. 2, so that sensor 18 is prevented from protruding in the height direction of the apparatus. As a result, the apparatus can be slimmed down.

What is claimed is:

1. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, and disposed entirely within a height of said driving-force-transmitting machine; and a rotation angle detecting sensor for detecting a rotation angle of said rotary detection member at any of plural rotary positions within a rotation of said rotary detection member;

wherein said rotary detection member is disposed on a side of said rotary member opposite a side of said rotary member on which said recording head is disposed.

2. The inkjet recording apparatus of claim 1, wherein said rotary member constitutes a final transmission member of said driving-force-transmitting machine.

3. The inkjet recording apparatus of claim 1, wherein said driving-force-transmitting machine further comprises at least one additional rotary member, wherein said rotary members of said driving-force-transmitting machine have rotational axes that are parallel to one another.

4. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a chassis comprising a chassis plate;

a driving-force-transmitting machine for transmitting driving force of said driving machine to said transferring machine, said driving-force-transmitting machine being mounted to said chassis plate and coupled between said driving machine and said transferring machine, said driving-force-transmitting machine including a plurality of rotary members respectively mounted on mutually parallel rotation shafts;

a rotary detection member mounted coaxially with the rotation shaft of one of said rotary members, and disposed entirely within a height of said driving-force-transmitting machine; and a rotation angle detecting sensor for detecting a rotation angle of said rotary detection member at any of plural rotary positions within a rotation of said rotary detection member;

wherein said rotary detection member is disposed on a side of said one of said rotary members opposite a side of said one of said rotary members on which said recording head is disposed.

5. The inkjet recording apparatus of claim 4, wherein said one of said rotary members constitutes a final transmission member of said driving-force-transmitting machine.

6. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, said rotary detection member having a radius and said rotary member having a radius, and said radius of said rotary member being greater than said radius of said rotary detection member; and a rotation angle detecting sensor for detecting a rotation angle of said rotary detection member at any of plural rotary positions within a rotation of said rotary detection member;

wherein said rotary detection member is disposed on a side of said rotary member opposite a side of said rotary member on which said recording head is disposed.

7. The inkjet recording apparatus of claim 6, further comprising a chassis, said driving-force-transmitting machine being mounted to said chassis;

wherein said driving-force-transmitting machine comprises at least one additional component other than said rotary member; and wherein said rotary detection member, and said driving-force-transmitting machine other than said rotary member, are arranged so as to be entirely within a vertical height of said rotary member when said chassis is set on a horizontal surface.

8. The inkjet recording apparatus of claim 6, wherein said rotary member constitutes a final transmission member of said driving-force-transmitting machine.

9. The inkjet recording apparatus of claim 6, wherein said driving-force-transmitting machine further comprises at least one additional rotary member; and said rotary members of said driving-force-transmitting machine have rotational axes that are parallel to one another.

10. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a plurality of rotary members respectively mounted on rotation shafts;

a rotary detection member mounted coaxially with the rotation shaft of one of said rotary members; and a rotation angle detecting sensor for detecting a rotation angle of said rotary detection member at any of plural rotary positions within a rotation of said rotary detection member, said rotation angle detecting sensor being disposed entirely within a height of said driving-force-transmitting member;

wherein said rotary detection member is disposed on a side of said one of said rotary members opposite a side of said one of said rotary members on which said recording head is disposed.

11. The inkjet recording apparatus of claim 10, wherein said one of said rotary members constitutes a final transmission member of said driving-force-transmitting machine.

12. An inkjet recording apparatus comprising:

a recording head for ejecting ink from a plurality of nozzles;

a transferring machine for transferring a recording medium, on which an image is formed by attaching ink ejected from said head, in a recording medium transfer direction, said transferring machine being rotatable about a laterally-extending axis;

a driving machine for operating said transferring machine;

a chassis comprising a chassis plate;

a driving-force-transmitting machine for transmitting driving force of said driving machine to said transferring machine, said driving-force-transmitting machine being mounted to said chassis plate and coupled between said driving machine and said transferring machine, said driving-force-transmitting machine including a rotary member mounted on a rotation shaft;

a rotary detection member mounted coaxially with said rotation shaft of said rotary member, entirely within a height of said driving-force-transmitting machine and entirely within a height of said chassis; and a rotation angle detecting sensor for detecting a rotation angle of said rotary detection member;

wherein said rotary detection member and said transferring machine are disposed on laterally opposite sides of said chassis plate; and wherein said rotary detection member is disposed on a side of said rotary member opposite a side of said rotary member on which said recording head is disposed.

13. The inkjet recording apparatus of claim 12, wherein said rotation angle detecting sensor is operable to detect a rotation angle of said rotary detection member at any of plural rotary positions within a rotation of said rotary detection member.

14. The inkjet recording apparatus of claim 12, wherein said rotary detection member comprises a disk.

15. The inkjet recording apparatus of claim 12, wherein said rotary member constitutes a final transmission member of said driving-force-transmitting machine.

16. The inkjet recording apparatus of claim 12, wherein said driving-force-transmitting machine further comprises at least one additional rotary member, wherein said rotary members of said driving-force-transmitting machine have rotational axes that are parallel to one another.

17. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, and disposed entirely within a height of said driving-force-transmitting machine; and a rotation angle detecting sensor for detecting a rotation angle of said rotary detection member;

wherein said rotary detection member comprises a disk; and wherein said rotary detection member is disposed on a side of said rotary member opposite a side of said rotary member on which said recording head is disposed.

18. The inkjet recording apparatus of claim 17, wherein said rotary member constitutes a final transmission member of said driving-force-transmitting machine.

19. The inkjet recording apparatus of claim 17, wherein said driving-force-transmitting machine further comprises at least one additional rotary member, wherein said rotary members of said driving-force-transmitting machine have rotational axes that are parallel to one another.

20. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a chassis comprising a chassis plate;

a driving-force-transmitting machine for transmitting driving force of said driving machine to said transferring machine, said driving-force-transmitting machine being mounted to said chassis plate and coupled between said driving machine and said transferring machine, said driving-force-transmitting machine including a plurality of rotary members respectively mounted on mutually parallel rotation shafts;

a rotary detection member mounted coaxially with the rotation shaft of one of said rotary members, and disposed entirely within a height of said driving-force-transmitting machine; and a rotation angle detecting sensor for detecting a rotation angle of said rotary detection member;

wherein said rotary detection member comprises a disk;

wherein said rotary detection member is disposed on a side of said one of said rotary members opposite a side of said one of said rotary members on which said recording head is disposed.

21. The inkjet recording apparatus of claim 20, wherein said one of said rotary members constitutes a final transmission member of said driving-force-transmitting machine.

22. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, said rotary detection member having a radius and said rotary member having a radius, and said radius of said rotary member being greater than said radius of said rotary detection member; and a rotation angle detecting sensor for detecting a rotation angle of said rotary detection member;

wherein said rotary detection member comprises a disk; and wherein said rotary detection member is disposed on a side of said rotary member opposite a side of said rotary member on which said recording head is disposed.

23. The inkjet recording apparatus of claim 22, further comprising a chassis, said driving-force-transmitting machine being mounted to said chassis;

wherein said driving-force-transmitting machine comprises at least one additional component other than said rotary member; and wherein said rotary detection member, and said driving-force-transmitting machine other than said rotary member, are arranged so as to be entirely within a vertical height of said rotary member when said chassis is set on a horizontal surface.

24. The inkjet recording apparatus of claim 22, wherein said rotary member constitutes a final transmission member of said driving-force-transmitting machine.

25. The inkjet recording apparatus of claim 22, wherein said driving-force-transmitting machine further comprises at least one additional rotary member; and said rotary members of said driving-force-transmitting machine have rotational axes that are parallel to one another.

26. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a plurality of rotary members respectively mounted on rotation shafts;

a rotary detection member mounted coaxially with the rotation shaft of one of said rotary members; and a rotation angle detecting sensor for detecting a rotation angle of said rotary detection member, said rotation angle detecting sensor being disposed entirely within a height of said driving-force-transmitting machine;

wherein said rotary detection member comprises a disk; and wherein said rotary detection member is disposed on a side of said rotary member opposite a side of said rotary member on which said recording head is disposed.

27. The inkjet recording apparatus of claim 26, wherein said one of said rotary members constitutes a final transmission member of said driving-force-transmitting machine.

28. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a gear mounted on a rotation shaft;

a rotary detection member mounted coaxially with said rotation shaft of said gear, and a plurality of position indication portions formed at equal intervals circumferentially about an entirety of said rotary detection member, and at least a part of said position indication portions being disposed within a height of a tooth form of said gear; and a rotation angle detecting sensor for detecting a rotation angle of said rotary detection member based on a number of said position indication portions moved past a given location due to rotating of said rotary detection member.

29. The inkjet recording apparatus of claim 28, wherein said rotary detection member is unitarily molded with said gear.

30. The inkjet recording apparatus of claim 28, wherein said gear constitutes a final gear of said driving-force-transmitting machine.

31. The inkjet recording apparatus of claim 28, wherein said gear is disposed between said rotary detection member and said recording head.

32. The inkjet recording apparatus of claim 28, wherein said transferring machine comprises a transfer roller.

33. The inkjet recording apparatus of claim 28, wherein said driving machine comprises a dc motor.

34. The inkjet recording apparatus of claim 28, wherein said driving-force-transmitting machine further comprises at least one additional gear, wherein said gears of said driving-force-transmitting machine have rotational axes that are parallel to one another.

35. The inkjet recording apparatus of claim 28, wherein one of said gears constitutes a final gear of said driving-force-transmitting machine.

36. The inkjet recording apparatus of claim 28, wherein said gear constitutes a final transmission member of said driving-force-transmitting machine.

37. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, and a plurality of position indication portions formed at equal intervals circumferentially about an entirety of said rotary detection member; and a rotation angle detecting sensor including a light-emitting section for irradiating detecting light toward at least one of said position indication portions of said rotary detection member, and a light-receiving section for receiving the detecting light irradiated from the light-emitting section, and being disposed opposite to the light-emitting section with respect to said rotary detection member, wherein said rotation angle detecting sensor detects a rotation angle of said rotary detection member by recognizing light-shading and light-transmission of the detecting light at the light-receiving section when said position indication portions move due to rotating of said rotary detection member, and one of the light-emitting section and the light-receiving section is disposed between the rotary member and said rotary detection member such that at least a portion of said one of said light-emitting section and said light-receiving section is disposed radially inwardly of an outer circumference of said rotary detection member and radially inwardly of an outer circumference of said rotary member; and wherein said rotary detection member is disposed on a side of said rotary member opposite a side of said rotary member on which said recording head is disposed.

38. The inkjet recording apparatus of claim 37, wherein said transferring machine comprises a transfer roller.

39. The inkjet recording apparatus of claim 37, wherein said driving machine comprises a dc motor.

40. The inkjet recording apparatus of claim 37, wherein said driving-force-transmitting machine further comprises at least one additional rotary member, wherein said rotary members of said driving-force-transmitting machine have rotational axes that are parallel to one another.

41. The inkjet recording apparatus of claim 40, wherein said rotary members comprise gears, and one of said gears comprises a final gear of said driving-force-transmitting machine.

42. The inkjet recording apparatus of claim 37, wherein said rotary member constitutes a final transmission member of said driving-force-transmitting machine.

43. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, and a plurality of position indication portions formed at equal intervals circumferentially about an entirety of said rotary detection member; and a rotation angle detecting sensor including a light-emitting section for irradiating detecting light toward at least one of said position indication portions of said rotary detection member, and a light-receiving section for receiving the detecting light irradiated from the light-emitting section, and being disposed opposite to the light-emitting section with respect to said rotary detection member, wherein said rotation angle detecting sensor detects a rotation angle of said rotary detection member by recognizing light-shading and light-transmission of the detecting light at the light-receiving section when said position indication portions move due to rotating of said rotary detection member, and one of the light-emitting section and the light-receiving section is disposed between the rotary member and said rotary detection member;

wherein a diameter of said rotary detection member is not more than a diameter of the rotary member located coaxially with said rotary detection member; and wherein said rotary detection member is disposed on a side of said rotary member opposite a side of said rotary member on which said recording head is disposed.

44. The inkjet recording apparatus of claim 43, wherein said rotary member constitutes a final transmission member of said driving-force-transmitting machine.

45. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, and a plurality of position indication portions formed at equal intervals circumferentially about an entirety of said rotary detection member; and a rotation angle detecting sensor including a light-emitting section for irradiating detecting light toward at least one of said position indication portions of said rotary detection member, and a light-receiving section for receiving the detecting light irradiated from, the light-emitting section, and being disposed opposite to the light-emitting section with respect to said rotary detection member, wherein said rotation angle detecting sensor detects a rotation angle of said rotary detection member by recognizing light-shading and light-transmission of the detecting light at the light-receiving section when said position indication portions move due to rotating of said rotary detection member, and one of the light-emitting section and the light-receiving section is disposed between the rotary member and said rotary detection member;

wherein the rotary member is a final gear mounted coaxially with said transferring machine; and wherein said rotary detection member is disposed on a side of said rotary member opposite a side of said rotary member on which said recording head is disposed.

46. An inkjet recording apparatus comprising:

a recording head for ejecting ink from a plurality of nozzles;

a transferring machine for transferring a recording medium, on which an image is formed by attaching ink ejected from said head, in a recording medium transfer direction;

a driving machine for operating said transferring machine;

a driving-force-transmitting machine for transmitting driving force of said driving machine to said transferring machine, and coupled between said driving machine and said transferring machine, said driving-force-transmitting machine including a rotary member mounted on a rotation shaft;

a rotary detection member mounted coaxially with said rotation shaft of said rotary member, and including a detection portion to be detected, said detection portion extending in a radial direction and being formed along an entire rim of said rotary detection member; and a rotation angle detecting sensor for detecting a rotation angle responsive to rotating of said rotary detection member, and being disposed between the rotary member and said rotary detection member such that at least a portion of said rotation angle detecting sensor is disposed radially inwardly of an outer circumference of said rotary detection member and radially inwardly of an outer circumference of said rotary member; and wherein said rotary detection member is disposed on a side of said rotary member opposite a side of said rotary member on which said recording head is disposed.

47. The inkjet recording apparatus of claim 46, wherein said transferring machine comprises a transfer roller.

48. The inkjet recording apparatus of claim 46, wherein said driving machine comprises a dc motor.

49. The inkjet recording apparatus of claim 46, wherein said driving-force-transmitting machine further comprises at least one additional rotary member, wherein said rotary members of said driving-force-transmitting machine have rotational axes that are parallel to one another.

50. The inkjet recording apparatus of claim 49, wherein said rotary members comprise gears, and one of said gears comprises a final gear of said driving-force-transmitting machine.

51. The inkjet recording apparatus of claim 46, wherein said rotary member constitutes a final transmission member of said driving-force-transmitting machine.

* * * * *